United States Patent [19]

Kisor

[11] 4,015,707

[45] Apr. 5, 1977

[54] CARRIER FOR SEMICONDUCTOR COMPONENTS

[75] Inventor: Thaddeus William Kisor, Flemington, N.J.

[73] Assignee: RCA Corporation, New York, N.Y.

[22] Filed: June 7, 1976

[21] Appl. No.: 694,045

[52] U.S. Cl. ..... 206/328; 339/17 R; 361/420

[51] Int. Cl.[2] ..... B65D 73/02

[58] Field of Search ..... 206/328; 339/17 R, 17 B; 317/101 R, 101 C, 101 CP

[56] References Cited

UNITED STATES PATENTS

| | | | |
|---|---|---|---|
| 3,380,016 | 4/1968 | Samson et al. | 206/328 X |
| 3,667,335 | 11/1976 | Walkow | 206/328 X |

*Primary Examiner*—George T. Hall

*Attorney, Agent, or Firm*—H. Christoffersen; R. P. Williams; R. A. Hays

[57] ABSTRACT

A carrier for semiconductor components comprises a semi-rigid strip having a plurality of protrusions extending from one side thereof. The protrusions provide means for securing the components to the carrier for in-line processes, storage and shipping purposes, or the like.

7 Claims, 4 Drawing Figures

CARRIER FOR SEMICONDUCTOR COMPONENTS

The present invention relates generally to carriers for semiconductor components and, in particular, relates to those carriers having protrusions providing means for securing the components thereto.

In the conventional manufacture of semiconductor components, after the semiconductor chip is mounted in a header and sealed a number of steps must still be performed on each component before it is ready for customer use. Some of these steps are, for example, final electrical testing, marking, boxing, storage and shipping. Usually the components are transported between steps, i.e., from machine to machine, for example, in relatively large volume bins into which the components are placed upon the completion of a given step. The components are generally dumped from the transport bin into a receiving bin at the station where the next step is to take place. Such handling results in a loss of identity of each chip, i.e., the wafer and the position therein from which it originated, and often physical damage, such as bent leads fo example. The problem of bent leads is such that a lead straightening step is routinely performed prior to boxing.

It is desirable therefore to reduce the number of bin transfers of components during final processing. The present novel carrier eliminates the use of bins while maintaining chip orientation and further substantially eliminating the bent lead problem discussed above.

Figure 1:
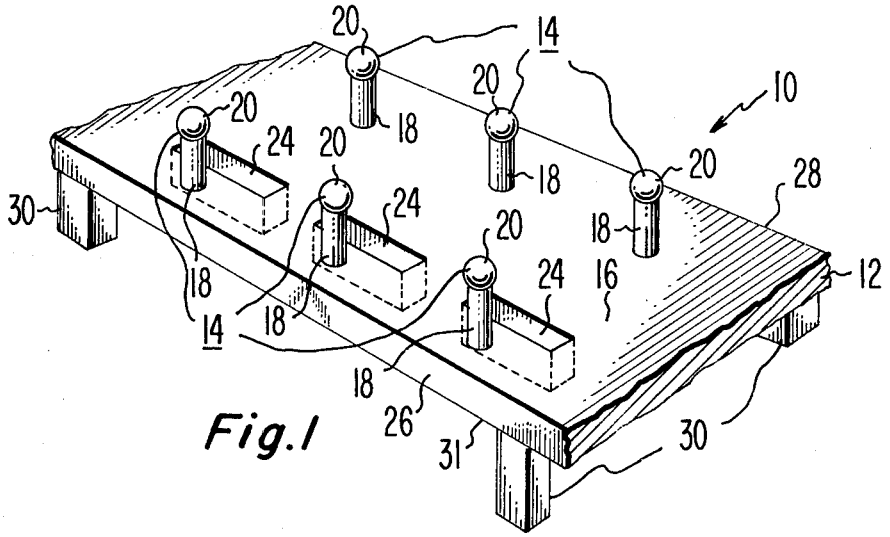
FIG. 1 is a perspective view of a portion of the present novel carrier, not drawn to scale.

The present novel carrier, a portion of which is indicated generally at 10 in the drawings, comprises an elongated strip 12 of semi-rigid material, for example a plastic material. A plurality of protrusions 14 extend from one side 16 thereof. Each protrusion 14 has a stem portion 18 and a knob portion 20. The protrusions 14 provide means for securing semiconductor components of the type shown generally at 22 in FIG. 2, to the strip 12.

The carrier 10 further contains slots 24 which provide means for aligning the components 22 on the strip 12. In the preferred embodiment, the plurality of protrusions 14 are positioned along opposite substantially parallel elongated edges 26 and 28 of the strip 12. Further, it is preferred that each member of the protrusions 14 along one edge, 26 for example, be substantially perpendicularly, with respect to the edge 26, aligned with a member of the protrusions 14 adjacent the other edge 28. Each slot 24 is preferably positioned between two aligned protrusions 14 and is located to correspond to the position of the leads on the component 22 The strip 12 may be provided with a plurality of legs 30 extending away from the strip 12 from another side 31. A discussion of the dimensional features of the strip 12 are discussed after the detailed description of the component 22 presented below.

Figure 2:
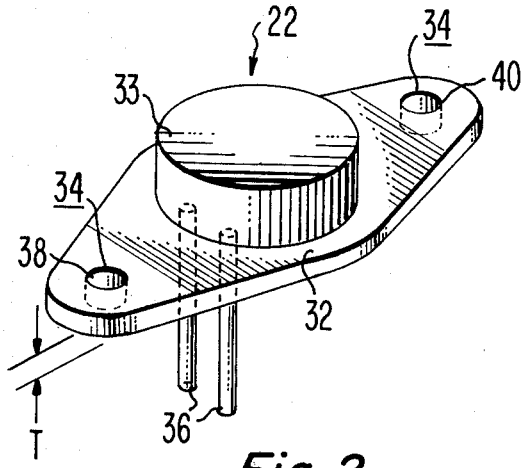
FIG. 2 is a perspective representation of a semiconductor component, not drawn to scale.

A semiconductor component 22 of the general type which can be utilized in conjunction with the present carrier 10 is shown in FIG. 2. The component 22 comprises a header 32 of thickness T having a cap portion 33 thereon. The header 32 comprises at least one hole 34 but usually has a pair of such holes 34. The holes 34, usually used for securing the component 22 to a circuit board, or the like, not shown, have a known diameter with known tolerances. The holes 34 may be designated as being "through" holes having a depth equal to the thickness of the header 32, i.e., T. The component 22 usually has a pair of leads 36 extending away from the header 32 in a direction opposite that of the cap portion 33.

Figure 3:
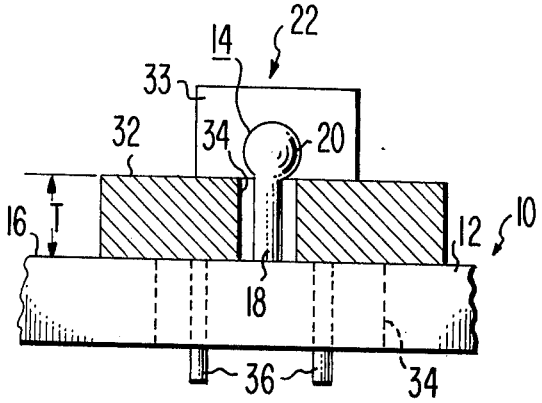
FIG. 3 is an edge view, partly in section, of a semiconductor component secured to the present novel carrier, not drawn to scale.

The discussion of the dimensional features of the portion 10 which follows will be better understood by reference to FIG. 3 of the drawings. Therein an edge view of the strip 12, having a semiconductor component 22 secured thereto, is shown. The header 32 of the component 22 is shown in section so that the relationship between one hole 34 therein and a protrusion 14 is clearly exhibited. As shown, the stem portion 18 of the protrusion 14 extending between the side 16 of the strip and the knob portion 20 is substantially equal to the thickness "T" of the header 32. The knob portion 20 of the protrusion 14 extends substantially completely through the hole 34 in the header 32. The size of the knob portion 20 should be such that it must be compressed for the header 32 to be passed thereover. That is, the knob portion 20 should be slightly larger than the hole 34 so that when the header 32, with the hole 34 aligned with the knob portion 20, is pressed against the knob portion 20, the knob portion 20, being of resilient semi-rigid material, compresses enough so that it passes through the hole 34. Thus when the header 32 is pressed until it contacts the surface 16, the knob portion 20 emerges from the hole 34 and expands slightly thereby securing the header 32 to the strip 12. That is, the size difference between the comparatively larger knob portion 20 and the comparatively smaller hole 34 should be within the resilient limits of the knob portion 20. While shown as generally spherical in shape the knob portion 20 can be other shapes, such as triangular, or the like, so long as the above size requirements are provided.

The slots 24 are positioned such that when the pair of leads 36 of a component 22 are aligned therewith at least one hole 34 of the component 22 is substantially aligned with a knob portion 20. Preferably the holes 34 are aligned with knob portions 20 of a pair of protrusions 14 located on opposing edges, 26 and 28, of the strip 12, as shown in FIG. 4.

Figure 4:
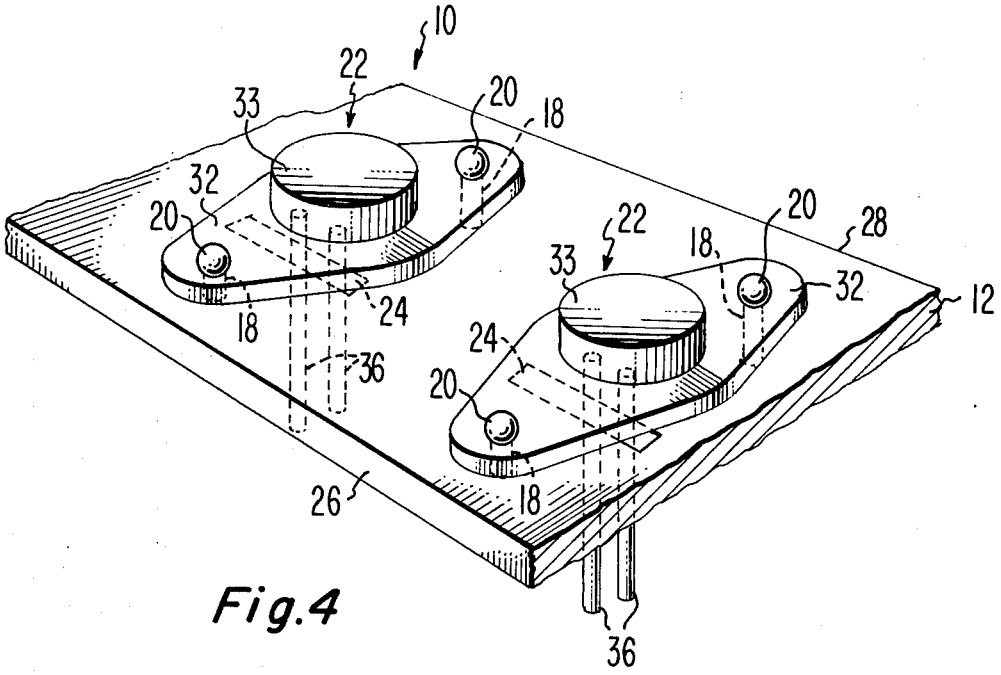
FIG. 4 is a perspective view of a portion of the present novel carrier having a semiconductor component secured thereto, not drawn to scale.

From the above description and by referring to FIG. 4, it can be seen that a plurality of components 22 can be secured to a given strip 12. In practice the strip 12 has a predetermined length and therefore holds a predetermined number of components.

The present novel carrier can be fabricated using known plastic molding procedures, for example known injection molding machines. This is advantageous because the carriers can be easily color coded. This would allow for the rapid identification of different type devices.

In practice, semiconductor components 22, as they complete electrical testing, or even just prior to electrical testing, are secured to the strip 12. Thereafter, the strip 12, having a plurality of components 22 secured thereto, is utilized to transport the components 22 through the remainder of the final production steps. Such steps can comprise operations such as a cleaning step, a masking step, a flash curing step, and a traying step wherein the strips are placed in trays for storage and subsequent shipping.

The use of the present novel carrier 10 eliminates a final lead straightening step and provides a continued knowledge of the origin of each semiconductor component's chip. That is, it provides the capability of determining which particular wafer, and the position thereon, each chip originated, at least until shipment of the component to a customer.

What is claimed is:

1. A carrier for semiconductor components having header containing at least one hole therein, said carrier comprising:

an elongated strip having a plurality of protrusions extending from one side thereof, each of said protrusions having a stem portion and a knob portion, said protrusions provide means for securing said components to said strip via said hole in said header; and means in said strip for aligning said hole of said semiconductor components with said knob portion.

2. A carrier as claimed in claim 1 wherein:

said aligning means is a slot through said strip.

3. A carrier as claimed in claim 1 wherein:

said plurality of protrusions are positioned along opposite, substantially parallel, elongated edges of said strip.

4. A carrier as claimed in claim 3 wherein:

each member of said protrusions along one edge is substantially perpendicularly, with respect to said one edge, aligned with a member of said protrusions on the other edge.

5. A carrier as claimed in claim 4 wherein:

said means for aligning is positioned between two aligned members of said protrusions.

6. A carrier as claimed in claim 1 wherein:

said stem portion is substantially equal to the thickness of said header.

7. A carrier as claimed in claim 1 wherein:

said knob portion is slightly larger than said hole, the size difference therebetween being within the resilient limits of said knob.

* * * * *